US005577518A

United States Patent [19]

Draghetti et al.

[11] Patent Number: 5,577,518

[45] Date of Patent: Nov. 26, 1996

[54] DEVICE FOR ROLLING ELONGATED ELEMENTS, PARTICULARLY FOR PRODUCING TOBACCO ITEMS

[75] Inventors: Fiorenzo Draghetti, Medicina; Salvatore Rizzoli, Bologna, both of Italy

[73] Assignee: G.D. Societa' Per Azioni, Bologna, Italy

[21] Appl. No.: 473,118

[22] Filed: Jun. 5, 1995

[30] Foreign Application Priority Data

Jun. 14, 1994 [IT] Italy ..... BO94A0276

[51] Int. Cl.[6] ..... A24C 5/10

[52] U.S. Cl. ..... 131/32; 131/58; 131/94

[58] Field of Search ..... 131/94, 29, 32, 131/58

[56] References Cited

U.S. PATENT DOCUMENTS

| | | | |
|---|---|---|---|
| 3,093,143 | 6/1963 | Rudszinat . | |
| 3,483,873 | 12/1969 | Hinzmann | 131/94 X |
| 4,316,606 | 2/1982 | Buys et al. . | |
| 4,437,658 | 3/1984 | Olson . | |
| 4,451,027 | 5/1984 | Alper . | |
| 4,515,358 | 5/1985 | Fukui . | |
| 4,825,882 | 5/1989 | Hinz . | |
| 5,024,242 | 6/1991 | Garthaffner et al. | 131/94 |
| 5,349,968 | 9/1994 | Rizzoli et al. | 131/94 |
| 5,390,684 | 2/1995 | Rizzoli et al. | 131/94 |

FOREIGN PATENT DOCUMENTS

| | | |
|---|---|---|
| 0045364A1 | 6/1981 | European Pat. Off. . |
| 2258221 | 2/1993 | United Kingdom . |

*Primary Examiner*—Jennifer Bahr
*Attorney, Agent, or Firm*—Klauber & Jackson

[57] ABSTRACT

A rolling device wherein elongated elements, in particular tobacco items, are fed in an orderly succession to the inlet of a rolling channel at a first speed, and are fed along the rolling channel at a second speed equal to half the first speed; the device presenting a rolling initiating unit located at the inlet of the rolling channel and in turn presenting a number of brake elements, each of which provides for engaging and gradually reducing the speed of a respective elongated element from the first speed to the second speed.

9 Claims, 6 Drawing Sheets

DEVICE FOR ROLLING ELONGATED ELEMENTS, PARTICULARLY FOR PRODUCING TOBACCO ITEMS

BACKGROUND OF THE INVENTION

The present invention relates to a device for rolling elongated elements, particularly for producing tobacco items.

The present invention is particularly advantageous for producing filter-tipped cigarettes, to which the following description refers purely by way of example.

In the manufacture of tobacco items in general, and cigarettes in particular, the items are rolled about their axis for various reasons. For example, filter-tipped cigarettes are rolled as part of laser perforating processes for producing ventilated cigarettes; or groups, each comprising two coaxial cigarette portions separated by a double filter, are rolled for connecting the cigarette portions to the double filter by means of an adhesive strip which is rolled about the filter and the adjacent ends of the cigarette portions.

For the sake of simplicity, specific reference will be made in the following description to the second of the above applications.

Known rolling devices for producing double filter-tipped cigarettes comprise a conveyor roller with a number of seats equally spaced about the outer surface of the roller and for receiving and retaining respective groups; and, normally, also a fixed plate facing an outer peripheral portion of the roller and defining with it a rolling channel of a width approximately equal to but no larger than the diameter of the cigarette portions and the double filter. The conveyor roller is rotated about its axis at constant speed to feed the groups and respective adhesive strips—connected in projecting manner to the groups—to the inlet of the channel at a first given speed, and to feed the groups along the channel at a second speed equal to half the first speed.

The rolling channel inlet is normally provided with a rolling initiating device normally defined by a fixed tooth which, as described and illustrated, for example, in U.S. Pat. No. 3,527,234, extends partly inside the channel and, as the groups arrive, cooperates with them by friction to withdraw them from the respective seats on the conveyor roller and rotate them backwards about their respective axes.

On known rolling devices of the above type, each group encounters the initiating tooth at full speed, and is subjected to extremely sharp (theoretically infinite) deceleration which, regardless of impact speed, can only be absorbed by elastic deformation of the group itself. Since, for output speeds over and above a given limit, impact is such as to result in irreparable damage to the group, the above fixed initiating tooth design obviously limits the output capacity of the filter assembly machine.

To at least partly overcome the above drawback, U.S. Pat. No. 4,825,882 relates to a rolling device wherein the fixed initiating tooth described above is replaced by a succession of initiating teeth fitted to a roller and moving with it at a speed equal to half the traveling speed of the groups.

Though this provides for increasing the output speed of the filter assembly machine, it fails to eliminate the extremely sharp fall in the traveling speed of the groups entering the rolling channel.

SUMMARY OF THE INVENTION

It is an object of the present invention to provide a rolling device for preventing the groups from being decelerated sharply on entering the rolling channel.

According to the present invention, there is provided a rolling device for elongated elements, particularly for producing tobacco items; the device comprising powered conveyor means presenting a transportation surface with a number of seats for receiving respective elongated elements; a plate facing a portion of the transportation surface, and presenting a rolling bed defining a rolling channel with said transportation surface; and rolling initiating means located at the inlet of said rolling channel; characterized in that said initiating means comprise braking means for successively engaging and gradually reducing the speed of said elongated elements from a first speed at which said conveyor means travel, to a second speed at which the elongated elements travel along said channel.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
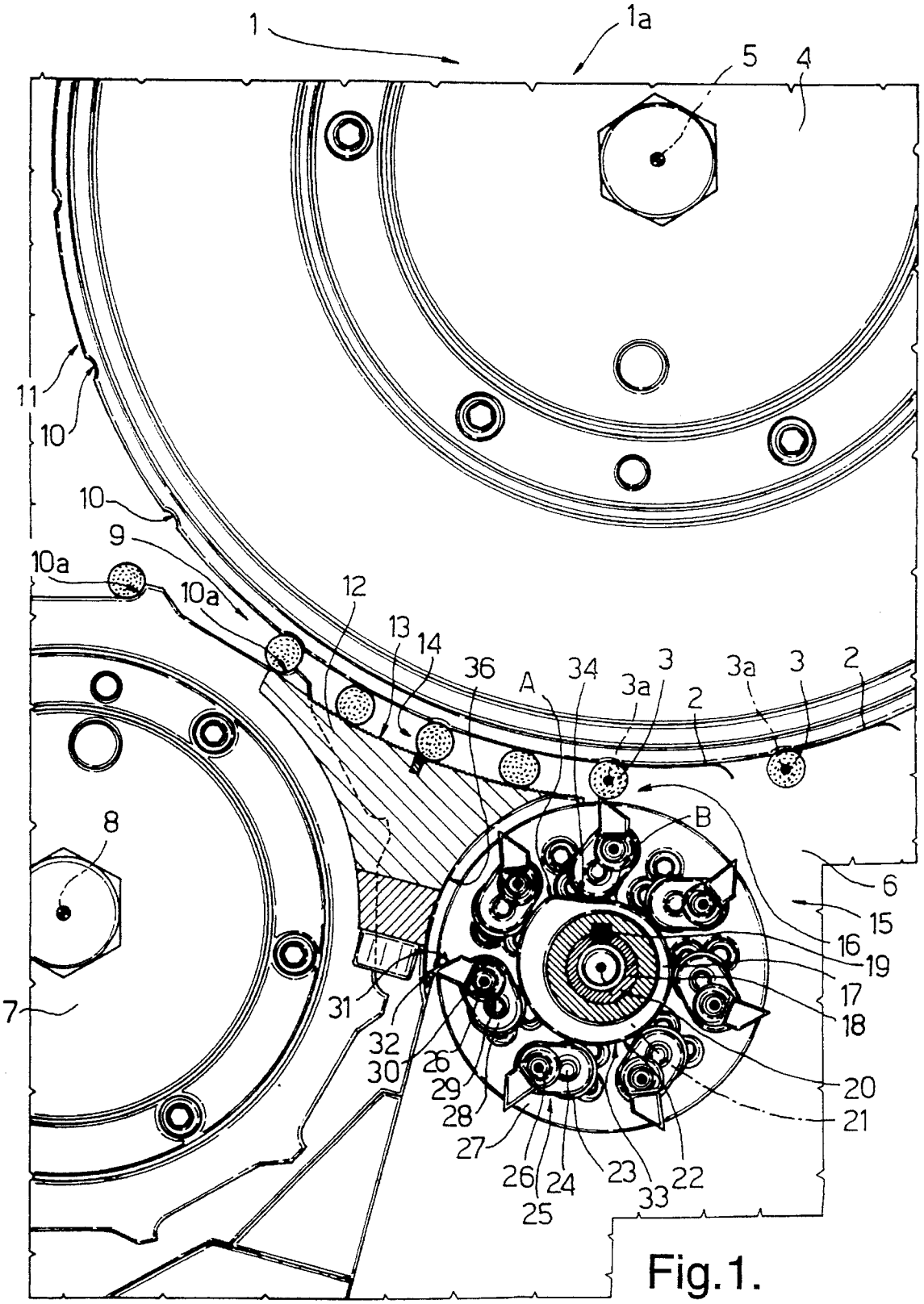
FIG. 1 shows a partially sectioned, schematic front view, with parts removed for clarity, of a first preferred embodiment of the rolling device according to the present invention.
Figure 2A:
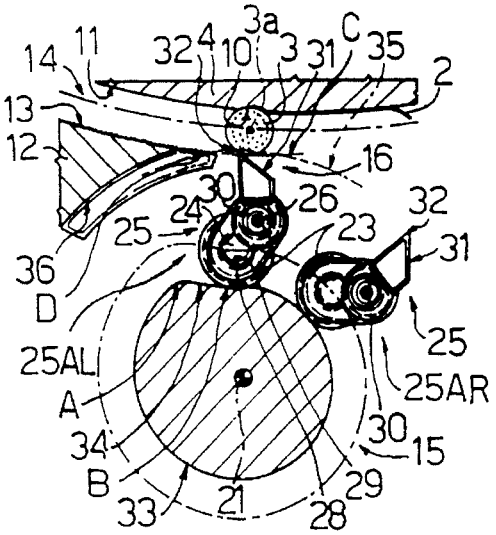
FIGS. 2(*a*) through 2(*g*) show a larger-scale view, with parts removed for clarity, of the FIG. 1 device in seven different operating positions.
Figure 2B:
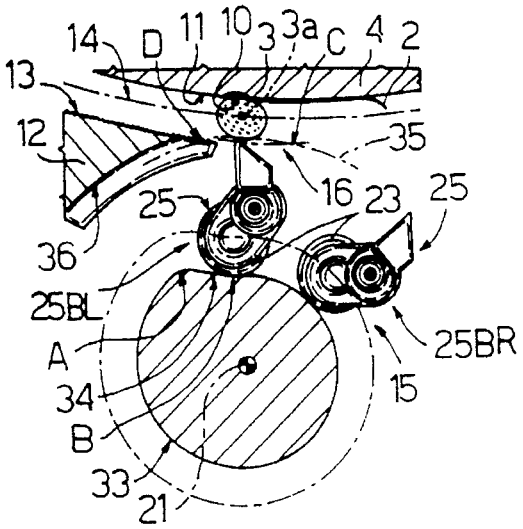
Figure 2C:
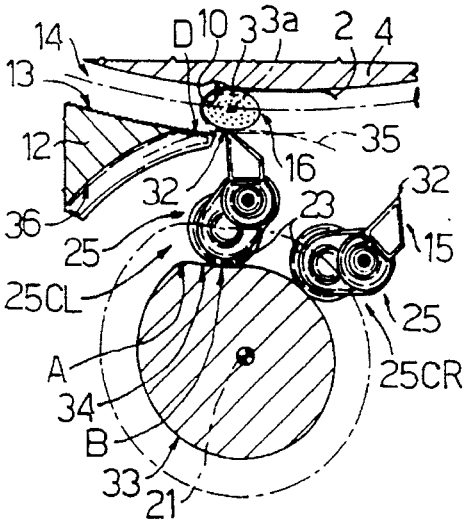
Figure 2D:
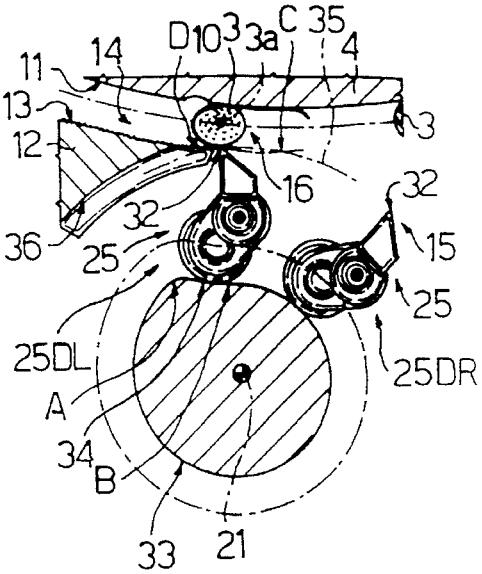
Figure 2E:
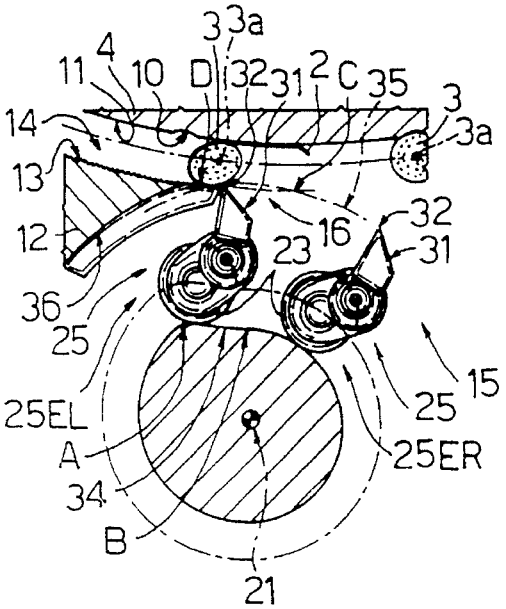
Figure 2F:
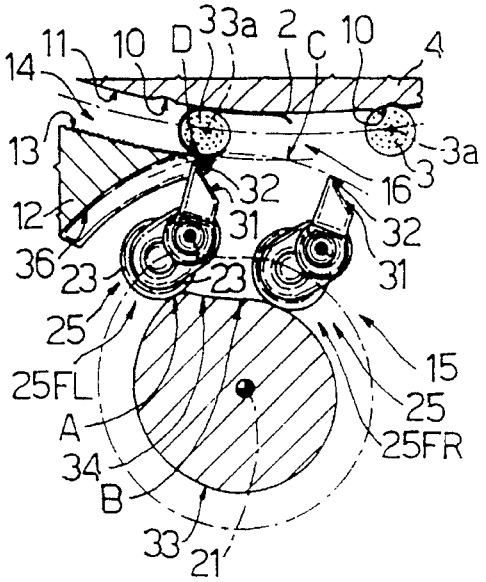
Figure 2G:
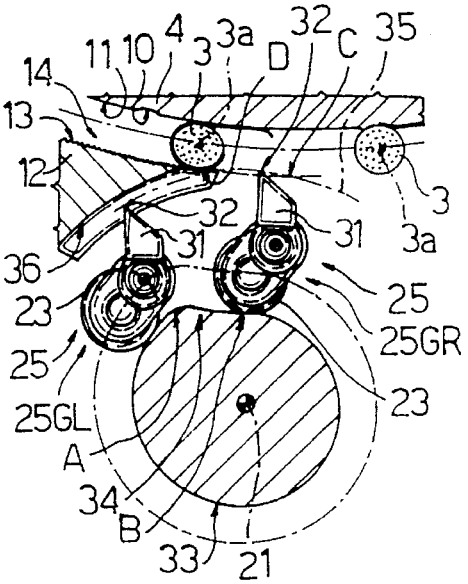

Number 1 in FIG. 1 indicates a rolling device forming part of a filter assembly machine 1*a*, and for connecting, by means of respective gummed strips 2, the two cigarette portions (not shown) and the intermediate double filter (not shown) of a number of groups 3 fed successively to device 1 by a known feed roller (not shown).

Device 1 comprises a roller 4 rotated clockwise (in FIG. 1) about its axis 5 by known drive means (not shown), and at a constant surface speed V1 in relation to a frame 6 parallel to the FIG. 1 and 2 planes; and a roller 7 mounted for rotation on frame 6, and rotating anticlockwise (in FIG. 1) at substantially the same surface speed as roller 4, and about an axis 8 parallel to axis 5. Roller 7 is tangent to roller 4 at a transfer station 9 where groups 3 are transferred from respective suction seats 10 equally spaced about the peripheral surface 11 of roller 4, to respective suction seats 10*a* equally spaced about the peripheral surface of roller 7. A front portion (in the traveling direction of roller 4) of each strip 2 is located between respective group 3 and respective seat 10, and a rear portion of each strip 2 extends rearwards of respective group 3 and is maintained contacting the peripheral surface 11 of roller 4 by known suction means (not shown).

Device 1 also comprises a fixed plate 12 facing a portion of surface 11 and defined, on the side facing surface 11, by a curved notched surface parallel to surface 11 and forming a rolling bed 13. Together with surface 11, rolling bed 13 defines a rolling channel 14, the width of which is approximately equal to but no larger than the diameter of groups 3, and is larger than the diameter of groups 3 if added to the depth of seat 10, so that a group 3 housed inside seat 10 could theoretically travel along the whole of channel 14 without coming into contact with rolling bed 13.

Device 1 also comprises a rolling initiating unit 15 adjacent to inlet 16 of channel 14, and which provides, with substantially no impact, for gradually braking each group 3 upstream from inlet 16, easing it out of respective seat 10, and rolling it backwards about respective axis 3*a* and along surface 11, so as to partly wind gummed strip 2 about the double filter (not shown) and the ends of the two cigarette portions (not shown).

Device 15 comprises a drum type cam 17 presenting an inner sleeve 18 fitted, by means of a key 19, to a shaft 20 supported in angularly fixed manner on frame 6 and presenting an axis 21 parallel to axes 5 and 8. Cam 17 presents a profile 22 for a number of tappet rollers 23, each of which is maintained contacting profile 22 by a known guide device (not shown), and is mounted for rotation, by means of a respective pin 24 parallel to axis 21, on one end of a respective rocker arm 25 pivoting, by means of a respective pin 26 parallel to pins 24, on a drum 27 coaxial with axis 21. Drum 27 is fitted in known manner (not shown) to a drive shaft (not shown) in turn fitted through frame 6 and by which drum 27 is rotated anticlockwise (in FIG. 1) about axis 21 at an angular speed equal to that of roller 4, and at a surface speed V2 lower than speed V1.

Each rocker arm 25 comprises a first arm 28, a first end of which supports tappet roller 23, and the second end of which is fitted through with an end portion 29 of pin 26; and a second arm 30 extending radially outwards from the free end of portion 29, and forming an angle of less than 180° with arm 28. Arm 30 comprises a tooth, the free end of which is defined by a surface 31 parallel to pin 26 and sloping towards axis 21 from the tip 32 of the front lateral edge of arm 30 with reference to the rotation direction of drum 27.

Profile 22 of cam 17 comprises a substantially spiral-shaped portion 33 extending over a roughly 330° arc AB—measured anticlockwise, i.e. in the rotation direction of drum 27—about axis 21 and from a point A with a maximum radius "R", to a point B with a minimum radius "r"; and a concave portion 34 extending over a roughly 30° arc BA—measured in the rotation direction of drum 27—and facing and substantially parallel to peripheral surface 11 of roller 4. By virtue of the shape of portions 33 and 34, each rocker arm 25, as it travels anticlockwise (in FIG. 1) along profile 22 at substantially the same angular speed as drum 27 and by rotating drum 27 about axis 21, rotates anticlockwise by a given arc about the axis of pin 26 as it travels along portion 33, and rotates clockwise by the same arc about the axis of pin 26 as it travels along portion 34.

Each rocker arm 25 therefore rotates about axis 21 together with drum 27, while at the same time oscillating about the rotation axis of 26 in relation to drum 27, so that, for each turn of drum 27, each tip 32 describes a closed path 35 at a surface speed V3 equal to the sum of two parts: a first part which is constant and substantially equal to the surface speed V2 of drum 27 about axis 21; and a second part V4 which is variable and depends on the rotation of rocker arm 25 about the axis of pin 26. More specifically, speeds V4 and V2 are in the same direction as roller 23 rolls along portion 33, and are in opposite directions as roller 23 rolls along portion 34; and portions 33 and 34 are so formed that, when roller 23 is tangent to profile 22 at point B, speed V3 reaches a substantially maximum value equal to V1, and, as roller 23 rolls along a given portion of portion 34, speed V4 assumes the same but opposite value to speed V2 so that speed V3 is zero.

Operation of rolling device 1 will now be described with reference to FIGS. 2(*a*) through 2(*g*) which show a pair of adjacent rocker arms 25 in seven different positions, one for each of the seven views in FIGS. 2(*a*) through 2(*g*) indicating fourteen characteristic positions of each rocker arm 25 about axis 21. For the sake of simplicity, each rocker arm 25 is indicated by a complex number consisting of number 25 and two letters, the first (A-G) indicating the view referred to, and the second (L-R) indicating the position (to the left or right) of the rocker arm 25 referred to in each view.

Also, operation of rolling device 1 will be described with reference to one rocker arm 25 and one group 3, as of the instant in which tip 32 of the rocker arm 25—in this case, rocker arm 25AR—is located at a point along path 35 upstream from two points C and D at which path 35 intersects the extension of the curved surface defining rolling bed 13.

Roller 23 of rocker arm 25AR rolls, without sliding, along the end portion of portion 33 of cam profile 22 preceding point B at which cam 17 presents a minimum radius "r"; and speed V4 of tip 32 of rocker arm 25AR is in the same direction as speed V2, so that speed V3 is greater than V2 but still less than V1, and rocker arm 25AR rotates anticlockwise (in FIG. 2(*a*)) about the axis of pin 26. At the same time, the respective group 3—only visible as of FIG. 2(*d*)—travels in time with tip 32 towards point C at speed V1 and at an angular speed of zero in relation to its axis 3*a*.

This situation continues until the rocker arm 25 in question reaches the position of rocker arm 25AL, the roller 23 of which is tangent to cam profile 22 substantially at point B of minimum radius "r", and the tip 32 of which is located between points C and D and travels at a speed V3 which has risen to a maximum value substantially equal to V1. Upon rocker arm 25 reaching the position of rocker arm 25AL, it is joined by respective group 3 which contacts surface 31 at a speed tending asymptotically towards zero.

At this point, speed V4 is inverted, rocker arm 25 begins rotating clockwise about the axis of pin 26, and speed V3 of tip 32 begins to fall so that arm 30 slows down respective group 3 which, when rocker arm 25 reaches the position of rocker arm 25BL (FIG. 2(*b*)), is eased out of respective seat 10, begins rolling backwards along surface 11, and is deformed elastically on surface 31.

Figure 3:
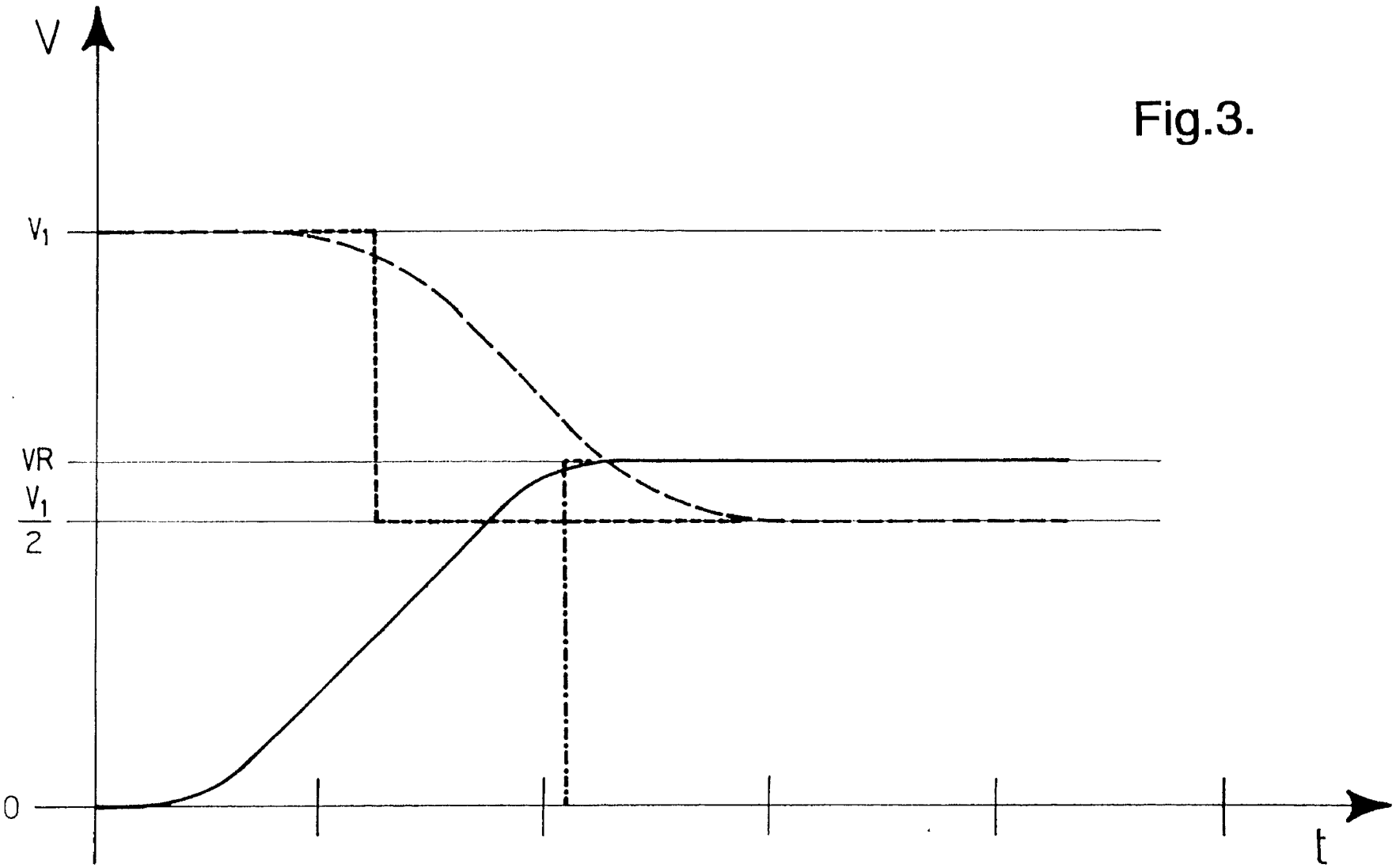
FIG. 3 shows two graphs illustrating two quantities relative to the motion of a product along the FIG. 1 device.

At the next instant, and more specifically upon rocker arm 25 reaching the position of rocker arm 25CL (FIG. 2(*c*)), the negative speed V4 of tip 32 equals, in absolute value, speed V2, so that tip 32 is positioned stationary in front of inlet 16 of rolling channel 14, and group 3, by now eased entirely out of respective seat 10, reaches its full rolling speed VR, rolls over tip 32 and deforms radially to roll over rocker arm 25 when this reaches the position of 25EL (FIG. 2(*e*)), and rolls with substantially no impact into rolling channel 14. Since tip 32 of rocker arm 25EL is substantially stationary, group 3 contacts, along diametrically opposite lines, fixed tip 32 on the one side, and surface 11 traveling at speed V1 on the other, so that axis 3*a* of group 3 travels, as shown in FIG. 3, at a speed equal to half speed V1. More specifically, due to elastic hysteresis, group 3 reaches its full rolling speed VR an instant before axis 3*a* reaches speed V1/2 at which axis 3*a* then proceeds along the whole of channel 14.

From the foregoing description, and as shown in FIG. 3, rolling device 1 therefore provides, with no impact, for gradually slowing down each group 3 before it enters channel 14, and so minimizing the stress to which group 3 is subjected.

It should be pointed out, however, that, due to said elastic hysteresis and as shown in FIGS. 2(*e*) and 2(*f*), groups 3 only regain their outer shape after entering channel 14 and being released by respective rocker arms 25 which, downstream from the position of rocker arm 25EL, engage a groove 36 formed laterally along plate 12. A remote possibility therefore exists that each group 3, at the start of channel 14 and as it regains its shape, may undergo a sufficiently sharp variation in surface speed as to damage it.

Figure 4A:
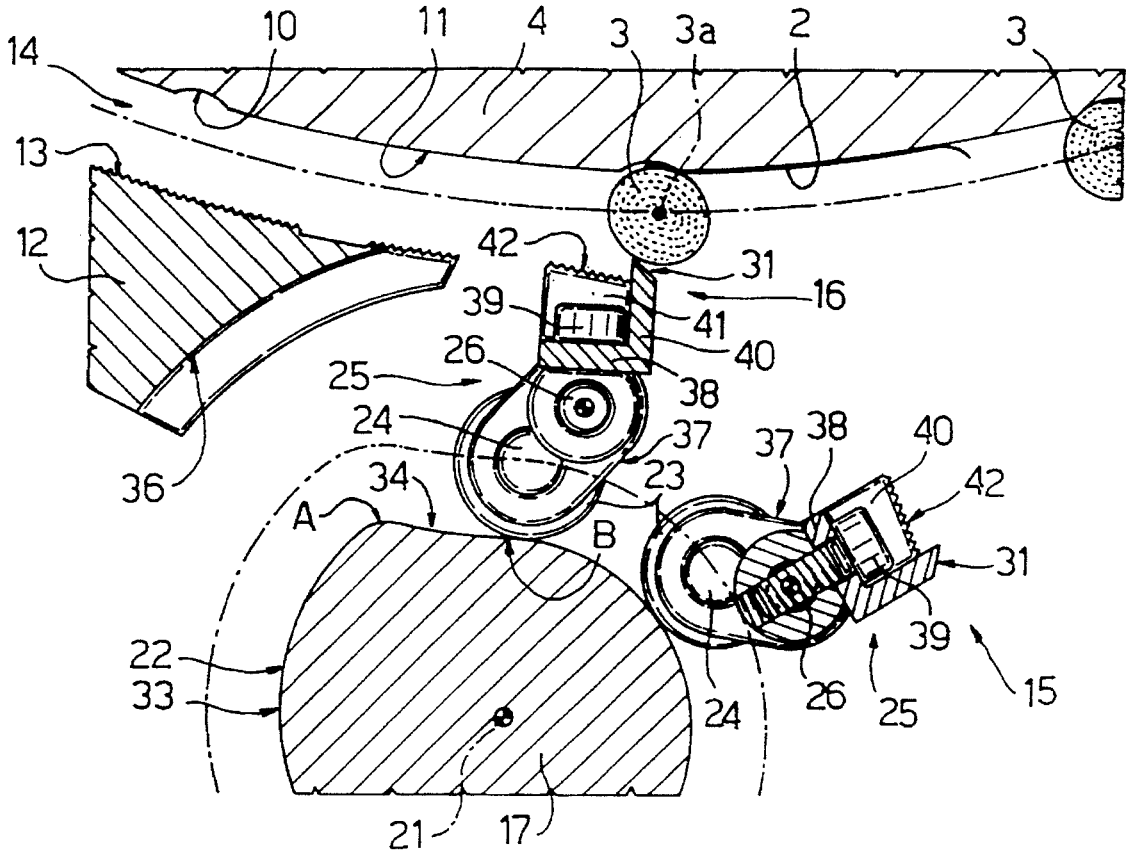
FIGS. 4(*a*) through 4(*c*) show a larger-scale view, with parts removed for clarity, of part of a second preferred embodiment of the rolling device according to the present invention and in three different operating positions.
Figure 4B:
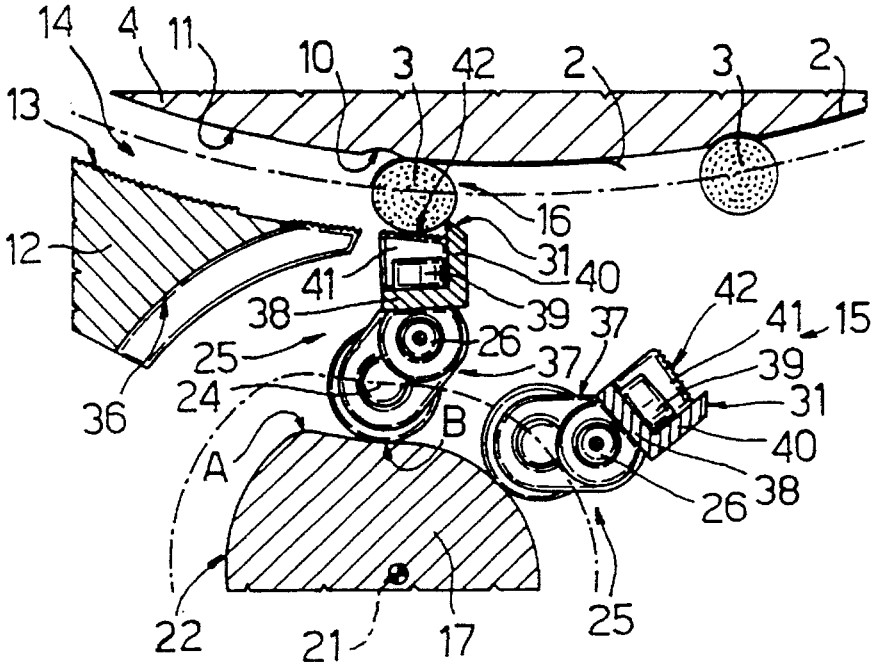
Figure 4C:
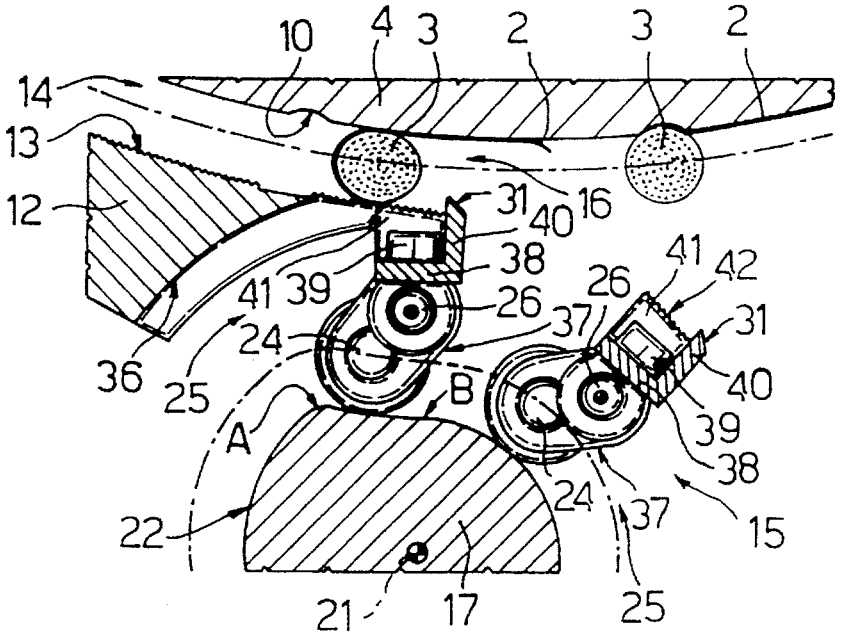

To eliminate this possibility, FIGS. 4(*a*) through 4(*c*) show a variation wherein arm 30 is replaced by an arm 37 comprising a substantially L-shaped portion in turn presenting a first portion 38 connected to pin 26 by a screw 39, and a second portion 40 extending outwards from the rear end of portion 38 in the rotation direction of drum 27 (FIG. 1) and in turn presenting an inclined end surface 31 similar to that of arm 30. The outer surface of portion 38 and the front surface of portion 40 are fitted with a substantially rectangular plate 41, an outer edge of which is notched in the same way as rolling bed 13 and defines a surface 42 for receiving group 3 once it rolls over surface 31 of portion 40, and which is aligned (FIG. 4(*c*)) with bed 13 before engaging groove 36, to enable group 3 to regain its shape before entering channel 14.

In the case of the variation of FIGS. 4(*a*) through 4(*c*), both the FIG. 3 graphs are to be considered shifted to the left, in that each group 3 reaches its full rolling speed VR and halves its traveling speed before entering channel 14.

We claim:

1. A rolling device for elongated elements (3), the device comprising powered conveyor means (4; 7) presenting a transportation surface (11) with a number of seats (10) for receiving respective elongated elements (3); a plate (12) facing a portion of the transportation surface (11), and presenting a rolling bed (13) defining a rolling channel (14) with said transportation surface (11); and rolling initiating means (15) located at the inlet (16) of said rolling channel (16); said initiating means (15) comprising movable braking means (25) which are moveable in relation to said plate (12) for successively engaging and gradually reducing the speed of said elongated elements (3) from a first speed at which said conveyor means (4) travel, to a rolling speed at which the elongated elements (3) travel along said channel (14).

2. A device as claimed in claim 1, wherein said braking means (25) comprise at least a brake element (30; 37) traveling cyclically along a path (35), a given portion (CD) of which upstream from said inlet (16) interferes with a respective said elongated element (3); activating means (27) and control means (17) being provided for varying the speed of said brake element (30; 37) between a maximum value and a minimum value defining a speed range comprising a value equal to said first speed (V1) and a zero value.

3. A device as claimed in claim 2, wherein said path (35) is substantially circular.

4. A device as claimed in claim 3, wherein said conveyor means (4) comprise a powered roller (4) rotating about a first axis (5) and having a number of peripheral suction seats (10) parallel to said first axis (5); said path (35) extending about a second axis (21) parallel to the first axis (5).

5. A device as claimed in claim 4, wherein said activating means (27) comprise a powered drum (27) rotating about said second axis (21); said brake element (30; 37) being connected to said drum (27) for rotation therewith about said second axis (21); said roller (4) rotating said seats (10) about the first axis (5) at said first speed (V1); and said drum (27) rotating in the opposite direction to said roller (4), and rotating said brake element (30; 37) about the second axis (21) at a second speed (V2) lower than said first speed (V1).

6. A device as claimed in claim 5, wherein said brake element (30; 37) forms part of a rocker arm (25) fitted to said drum (27) so as to rotate in relation to the drum (27) about a third axis (26) parallel to the second axis (21); said control means (17) comprising a fixed cam (17) connected to said rocker arm (25) and for controlling the position of the brake element (30; 37) about said third axis (26).

7. A device as claimed in claim 6, wherein said cam presents a profile (22) in turn comprising a first portion (33) cooperating with said rocker arm (25) so that the speed (V4) of said brake element (30; 37) about said third axis (26) is in the same direction as said second speed (V2), and a second portion (34) cooperating with said rocker arm (25) so that the speed (V4) of said brake element (30; 37) about said third axis (26) is in the opposite direction to said second speed (V2); the brake element (30; 37) traveling, in use, along said given portion (CD) of interference when said rocker arm (25) cooperates with said second portion (34) of said profile (22).

8. A device as claimed in claim 7, wherein said brake element is defined by an arm (30; 37) of said rocker arm (25), and comprises a tooth (30; 40) presenting a surface (31) which is positioned contacting a respective said elongated element (3) along said given portion (CD) of interference.

9. A device as claimed in claim 8, wherein said arm (37) also comprises a rolling surface (42) to the front of said tooth (40) in the rotation direction of said drum (27).

* * * * *